US007153340B2

(12) United States Patent
Kim et al.

(10) Patent No.: US 7,153,340 B2
(45) **Date of Patent: *Dec. 26, 2006**

(54) PROCESS FOR MANUFACTURING NANO-PHASE TAC-TRANSITION METAL BASED COMPLEX POWDER

(75) Inventors: Byong Kee Kim, Dongre-Ku (KR); Seong Hyeon Hong, Changwon-shi (KR); Yong Won Woo, Seongnam-shi (KR)

(73) Assignee: Korean Institute of Machinery and Materials, Taejon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/747,655

(22) Filed: Dec. 30, 2003

(65) Prior Publication Data

US 2004/0223865 A1 Nov. 11, 2004

(30) Foreign Application Priority Data

May 7, 2003 (KR) ..... 10-2003-0028766

(51) Int. Cl.
*C01B 31/30* (2006.01)
*C22C 29/06* (2006.01)

(52) U.S. Cl. ..... 75/351; 75/369; 423/440

(58) Field of Classification Search ..... 75/351, 75/369; 423/440

See application file for complete search history.

(56) References Cited

U.S. PATENT DOCUMENTS

| | | | | | |
|---|---|---|---|---|---|
| 1,928,453 | A * | 9/1933 | Kelley | 75/239 |
| 2,491,410 | A * | 12/1949 | Laughlin et al. | 501/87 |
| 3,379,647 | A * | 4/1968 | Smudski | 252/640 |
| 3,488,291 | A * | 1/1970 | Hardy et al. | 252/642 |
| 3,914,113 | A * | 10/1975 | Chiu | 428/539.5 |
| 4,008,090 | A * | 2/1977 | Miyake et al. | 501/91 |
| 5,352,269 | A * | 10/1994 | McCandlish et al. | 75/351 |
| 6,214,309 | B1 * | 4/2001 | Shaw et al. | 423/345 |
| 6,293,989 | B1 * | 9/2001 | Kim et al. | 75/351 |
| 6,511,551 | B1 * | 1/2003 | Kim et al. | 148/237 |
| 6,793,875 | B1 * | 9/2004 | Shaw et al. | 419/18 |
| 2002/0043130 | A1 * | 4/2002 | Kim et al. | 75/236 |

* cited by examiner

*Primary Examiner*—Ngoclan T. Mai
(74) *Attorney, Agent, or Firm*—Lowe, Hauptman, & Berner LLP

(57) ABSTRACT

Ultra fine TaC-transition metal based complex powder is prepared by: dispersing a mixture of a Ta-containing material and a transition metal-containing water soluble salt into a solvent; stirring the mixture and spray-drying the stirred material to obtain precursor powder; calcining the precursor powder to form ultra fine Ta-transition metal complex oxide powder; mixing the ultra fine Ta-transition metal complex oxide powder with nano-sized carbon particles, followed by drying to obtain complex oxide powder; and subjecting the dried complex oxide powder to reduction/carburization in a non-oxidizing atmosphere.

12 Claims, 2 Drawing Sheets

(a)

(b)

(c)

PROCESS FOR MANUFACTURING NANO-PHASE TAC-TRANSITION METAL BASED COMPLEX POWDER

BACKGROUND OF THE INVENTION

1. Field of the Invention

The present invention relates to a method for producing nano-phase TaC-transition metal based complex powder, and more particularly, to a method for producing nano-sized TaC-transition metal based complex powder for use in a solid carbide cutting tool.

2. Background of the Related Art

TaC is known as a material added to WC—TaC—Co based solid carbide cutting tools to increase high temperature hardness and inhibit reaction with stainless steel to be cut. Also, it is used as a main ingredient of TaC based cermet tools. Recently, it has been found that when ultra fine powders of TaC based carbides are used in a tool, the tool has increased hardness, transverse-rupture strength and wear-resistance. Therefore, TaC based powder as fine as possible is used in production of tools or molds.

According to the conventional methods for producing TaC powder, a powder mixture of Tantalum oxide and carbon is subjected to a thermal treatment at a high temperature of 1500° C. to 1600° C. in a non-oxidizing atmosphere, such as vacuum, inert atmosphere, hydrogen atmosphere, for reduction by carbon and carburization, to prepare TaC powder. However, such methods have disadvantages in that the invested cost of equipments is great and the power consumption is much, since reaction temperature is so high. Also, the produced TaC powder has a coarse particle size of about 1 to 2 μm.

SUMMARY OF THE INVENTION

Accordingly, the present invention has been made in view of the above problems, and it is an object of the present invention to provide ultra fine TaC-transition metal based complex powder by dissolving Ta-containing salt to water or mixing with organic solvent, spray-drying the solution, subjecting the dried product to a thermal treatment for oxidation to obtain Ta/transition metal complex oxide, mixing the complex oxide with nano-sized carbon particles, and subjecting the mixture to a thermal treatment for reduction/carburization.

To achieve the above object, in one embodiment, the present invention provides a method for producing ultra fine TaC-transition metal complex powder comprising the steps of: dispersing a mixture of a Ta-containing material and a transition metal-containing water soluble salt into a solvent, stirring the mixture and spray-drying the stirred material to obtain precursor powder; calcining the precursor powder to form ultra fine Ta-transition metal complex oxide powder; mixing the ultra fine Ta-transition metal complex oxide powder with nano-sized carbon particles, followed by drying to obtain complex oxide powder; and subjecting the dried complex oxide powder to reduction/carburization in a non-oxidizing atmosphere.

The mixture of a Ta-containing material is preferably Ta-based chloride salt or Ta oxalate, and the solvent is preferably water or organic solvent. Here, the transition metal is preferably contained in the complex powder in the range of 1 to 30 wt %.

Preferably, the calcination is performed at a temperature between 250° C. to 1000° C.

Also, the thermal treatment for reduction/carburization is performed by reduction at a temperature of 600° C. to 1100° C. in a non-oxidizing atmosphere such as vacuum, inert atmosphere, hydrogen atmosphere, etc., and then reduction and carburization at a temperature of 1000° C. to 1350° C.

BRIEF DESCRIPTION OF THE DRAWINGS

The above and other objects, features and advantages of the present invention will be apparent from the following detailed description of the preferred embodiments of the invention in conjunction with the accompanying drawing, in which.

DETAILED DESCRIPTION OF THE PREFERRED EMBODIMENT

Figure 1:
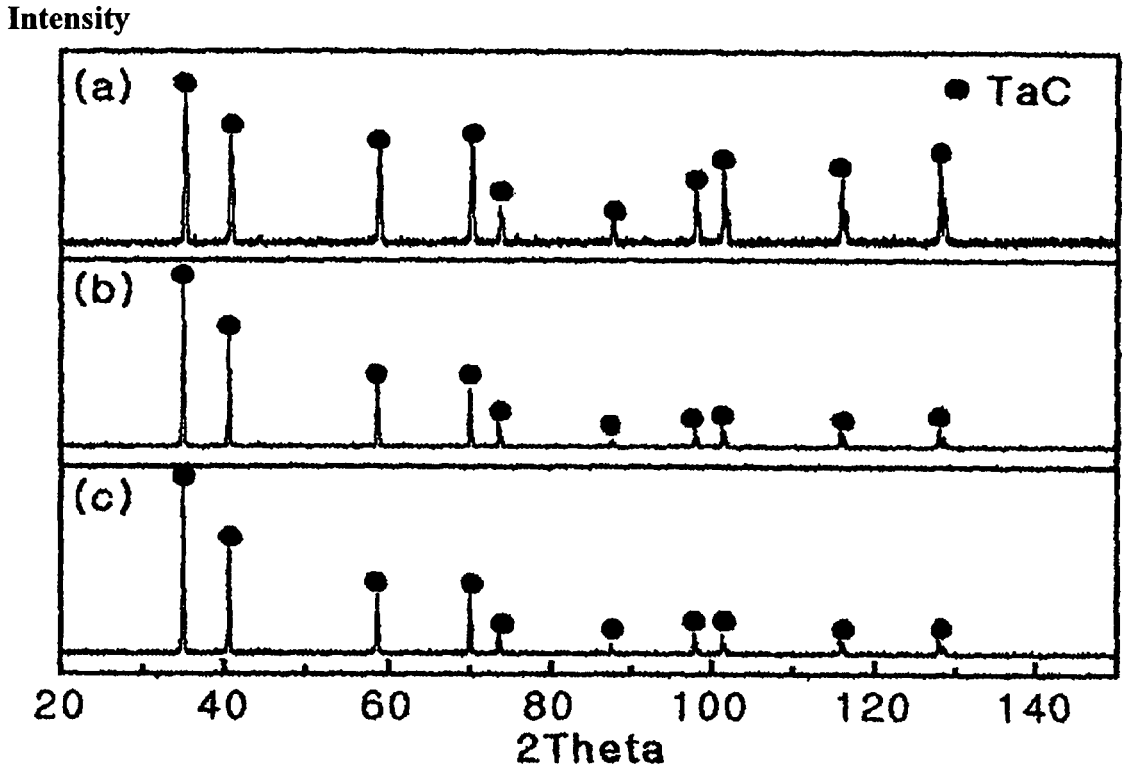
FIG. 1 is a graph showing X-ray diffraction pattern of the TaC—Co complex powder prepared according to the present invention.

Now, the present invention is described in detail.

Firstly, in order to prepare the TaC-transition metal based complex powder having the desired composition according to the present invention, a Ta-containing material and a metal salt containing a transition metal are dissolved or dispersed in a solvent, thereby forming a raw material mixture. Here, the Ta-containing material is preferably Ta-based chloride salt or Ta oxalate. By using this Ta-containing material it is possible to obtain ultra fine Ta-transition metal complex oxide powder after spray-drying or calcinations. The preferable solvent is water or organic solvent.

The transition metal usable in the present invention includes Co, Fe, Ni and the like. The added amount of the transition metal is preferably in the range of 1 to 30 wt % based on the total weight of the complex powder. When the added amount of the transition metal is 1 wt % or less based on the total weight of the complex powder, the thermal treatment to form TaC should be necessarily performed at a high temperature of over 1500° C., while when 30 wt % or more, the produced TaC-transition metal complex powder has a strong tendency to aggregate. Therefore, the amount of the transition metal in the TaC-transition metal complex powder is preferably in the range of 1 to 30 wt %.

Once the raw material mixture is prepared, the raw material mixture is spray-dried under common conditions to form precursor powder.

Next, the precursor powder is calcined and unnecessary ingredients other than the metal ingredients are removed by volatilization or reaction. As a result, ultra fine Ta/transition metal complex oxide is formed. The calcination is preferably performed at a temperature in the range of 250° C. to 1000° C. When the temperature of the calcination is lower than 250° C., non-metal organic compounds may remain. When the calcination is performed at a temperature of over 1000° C., since the complex oxide may grow, ultra fine oxide cannot be formed and the powder has a strong tendency to aggregate.

Then, nano-sized carbon particles are introduced to a milling jar, where the ultra fine Ta-transition metal complex oxide powder has been already loaded, and sufficiently milled in a dry atmosphere or a wet atmosphere such as hexane to thoroughly mix with the complex oxide.

The dried and mixed complex oxide powder may be reduced and carburized in a non-oxidizing atmosphere to form nano-sized TaC-transition metal based complex powder.

The reduction and cariburization process includes heating at a temperature of 600° C. to 1100° C. in a non-oxidizing atmosphere such as inert atmosphere, hydrogen atmosphere, etc. to reduce the transition metal based oxide and then at 1000° C. to 1350° C. to reduce and carburize Ta based oxides.

Here, it is preferred that the reduction of the transition metal is at least 600° C., preferably between 600° C. to 1100° C. When the reduction of the transition metal is performed at a temperature lower than 600° C., the reduction time gets longer and the reduction does not completed properly. The reduction at over 1100° C. is possible, however the reduction of TaC may be interfered by generation of moisture upon the thermal treatment for reduction/carburization of TaC.

Also, it is preferred that the reduction/carburization is performed at a temperature between 1000° C. to 1350° C. When the temperature for reduction/carburization is lower than 1000° C., reduction/carburization is not sufficiently carried out. When it exceeds 1350° C. TaC, particles may grow, which makes it difficult to obtain ultra fine powder.

Now, preferred embodiments of the present invention are concretely described.

EXAMPLE 1

In this Example, 196.45 g of $TaCl_5$ and 54.53 g of Co nitrate ($Co(NO_3)_2 \cdot 6H_2O$) were added to 557 □ of distilled water while stirring, so that the final target composition after reduction/carburization was TaC-10 wt % Co, and then, spray-dryed. In the drying step, the supply rate of the solution was 20 cc/min, the nozzle rotation speed was set to 11,000 rpm, and the intake temperature of heated air and the outlet temperature were 250° C. and 130° C., respectively.

The spray-dried precursor salt powder was kept at about 700° C. for 2 hours to remove residual moisture and non-metallic salts. Thus, ultra fine Ta—Co based complex oxide powder was formed.

12 g of the salt-free Ta—Co based complex oxide powder and 3.612 g of carbon powder as a reducing or carburizing agent were added and ball-milled to obtain Ta—Co based complex oxide powder with carbon added.

4 g of ball-milled complex oxide powder was heated to 900° C. at a rate of 10° C./min under a high purity of argon atmosphere of velocity 200 cc/min, and maintained for two hours. Then the powder was heated to final reduction temperature of 1250° C. at a rate of 7° C./min, and maintained for two hours at room temperature for cooling. The characteristics of thus obtained complex oxide powder of TaC-10 wt % Co was tested and shown in Table 1.

Also, the complex powder was subjected to the X-ray diffraction test. TaC phase was observed as shown in FIG. 1*a*. The crystal size of TaC was found to be about 52 nm.

Figure 2:
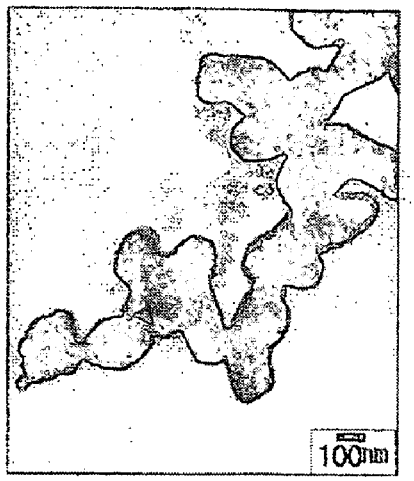
FIGS. 2*a* to 2*c* are tissue photographs of the TaC—Co complex powder prepared according to the present invention, taken by transmission electron microscopy.
Figure 2:
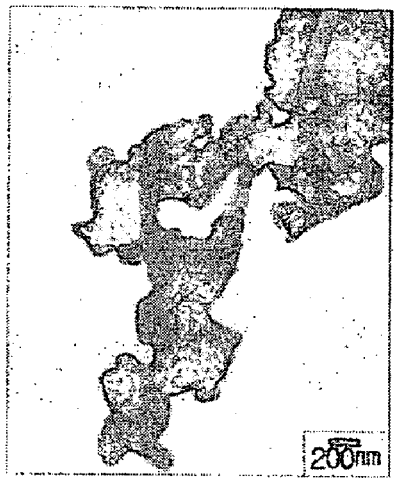
Figure 2:
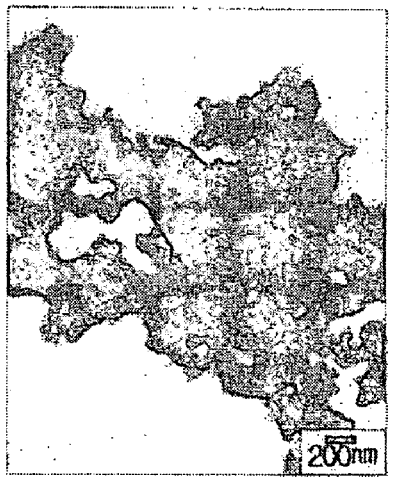

Meanwhile, upon examination of TaC—Co complex powder using a transmission electron microscope, it was confirmed that the powder contains particles having a size of 50 nm to 300 nm, as shown in FIG. 2.

EXAMPLE 2

In this Example, tantalum oxalate solution containing 175 g of $Ta_2O_5$ per 1000 cc of the solution and Co nitrate ($Co(NO_3)_2 \cdot 6H_2O$) were used as starting materials. 621.6 cc of tantalum oxalate solution and 24.68 g of Co nitrate are added to 4923 cc of distilled water and spray-dried while stirring so that the final target composition after reduction/carburization was TaC-5 wt % Co. The condition for spray-drying is same as the condition of example 1.

The spray-dried precursor salt powder was kept at about 500° C. for 2 hours to remove residual moisture and non-metallic salts. Thus, ultra fine Ta—Co based complex oxide powder was formed.

29 g of the salt-free Ta—Co based complex oxide powder and 7.52 g of carbon powder as a reducing or carburizing agent were added and ball-milled to obtain Ta—Co based complex oxide powder with carbon added.

9 g of ball-milled complex oxide powder was heated to 900° C. at a rate of 10° C./min under a high purity of argon atmosphere of velocity 1000 cc/min, and maintained for two hours. Then the powder was heated to final reduction temperature of 1250° C. at a rate of 7° C./min, and maintained for two hours at room temperature for cooling. The characteristics of thus obtained complex oxide powder of TaC-5 wt % Co was tested and shown in Table 1.

Also, the complex powder was subjected to the X-ray diffraction test. TaC phase was observed as shown in FIG. 1*b*. The crystal size of TaC was found to be about 46 nm.

Meanwhile, upon examination of TaC—Co complex powder using a transmission electron microscope, it was confirmed that the powder comprises particles having a size of 50 nm to 300 nm, as shown in FIG. 2*b*.

EXAMPLE 3

In this Example, Ta—Co based complex oxide powder with carbon added was prepared by using the same method as the one of example 2.

9 g of ball-milled complex oxide powder was heated to 800° C. at a rate of 10° C./min under a high purity of argon atmosphere of velocity 1000 cc/min, and maintained for two hours. Then the powder was heated to final reduction temperature of 1100° C. at a rate of 7° C./min, and maintained for two hours at room temperature for cooling. The characteristics of thus obtained complex oxide powder of TaC-5 wt % Co was tested and shown in Table 1.

Also, the complex powder was subjected to the X-ray diffraction test. TaC phase was observed as shown in FIG. 1*c*. The crystal size of TaC was found to be about 46 nm.

Meanwhile, upon examination of TaC—Co complex powder using a transmission electron microscope, it was confirmed that the powder comprises particles having a size of 50 nm to 300 nm, as shown in FIG. 2*c*.

TABLE 1

| | Composition | Reduction conditions | Phases (XRD) | Size of TAC | Size of complex powder |
|---|---|---|---|---|---|
| Conventional Example | 100 TaC | 1600° C., 2 h | TaC | 1~2 □ | — |
| Example 1 | 90 TaC-10 Co | 900° C., 2 h + 1250° C., 2 h | TaC, Co | 52 nm | 50~300 nm |
| Example 2 | 95 TaC-5 Co | 900° C., 2 h + 1250° C., 6 h | TaC, Co | 46 nm | 50–300 nm |
| Example 3 | 95 TaC-5 Co | 800° C., 2 h + 1100° C., 2 h | TaC, Co | 46 nm | 50–300 nm |

In Table 1, Conventional Example was TaC powder prepared by mixing $Ta_2O_5$ having a particle size of 1 to 2 μm and carbon and performing reduction/carburization at about 1600° C. for 2 hours.

As can be seen from Table 1, it is noted that the TaC powder according to the present invention was finer than the conventional TaC powders and moreover, the TaC-transition metal based complex powder prepared therefrom was nano-sized ultra fine particles.

As described above, according to the present invention, there is provided ultra fine TaC-transition metal based complex powder by dispersing a mixture of a Ta-containing material and a transition metal-containing water soluble salt into a solvent, stirring the mixture and spray-drying the stirred material to obtain precursor powder; calcining the precursor powder to form ultra fine Ta-transition metal complex oxide powder; mixing the ultra fine Ta-transition metal complex oxide powder with nano-sized carbon particles, followed by drying to obtain complex oxide powder; and subjecting the dried complex oxide powder to reduction/carburization in a non-oxidizing atmosphere.

While the present invention has been described with reference to the preferred examples, it is to be appreciated that those skilled in the art can make change or modification thereof without departing from the scope and spirit of the present invention and such change or modification fall in the scope of the present invention.

What is claimed is:

1. A method of producing TaC-transition metal based complex powder comprising the steps of:

a) dispersing a mixture of a Ta-containing material and a transition metal-containing water soluble salt into a solvent, stirring the mixture and spray-drying the stirred material to obtain a precursor powder;

b) calcining the precursor powder to form ultra fine Ta-transition metal complex oxide powder;

c) mixing the ultra fine Ta-transition metal complex oxide powder with nano-sized carbon particles, followed by drying to obtain a complex oxide powder; and d) subjecting the dried complex oxide powder to reduction at a temperature between 600 to 1,100° C., and then reduction and carburization at a temperature between 1,000 and 1,350° C. in a non-oxidizing atmosphere.

2. The method according to claim 1, wherein said mixture of a Ta-containing material is Ta-based chloride salt, or Ta oxalate, and said solvent is water or organic solvent.

3. The method according to claim 2, wherein the content of the transition metal in the complex powder is in the range of 1 to 30 wt %.

4. The method according to claim 3, wherein the calcining is performed at a temperature between 250 to 1000° C.

5. The method according to claim 1, wherein the content of the transition metal in the complex powder is in the range of 1 to 30 wt %.

6. The method according to claim 1, wherein the calcining is performed at a temperature between 250 to 1000° C.

7. The method according to claim 1, wherein the transition metal of the transition-metal containing salt comprises Co, Fe or Ni.

8. The method according to claim 2, wherein the Ta-containing material is a Ta-based chloride salt.

9. The method according to claim 8, wherein the Ta-based chloride salt is $TaCl_5$.

10. The method according to claim 1, wherein the transition metal-containing water soluble salt is cobalt nitrate.

11. The method according to claim 1, wherein the TaC-transition metal based complex powder has a particle size of from 50 to 300 nm.

12. The method according to claim 1, wherein the TaC-transition metal based complex powder has a TaC phase having a TaC crystal size of from 46 to 52 nm.

* * * * *

UNITED STATES PATENT AND TRADEMARK OFFICE

CERTIFICATE OF CORRECTION

PATENT NO. : 7,153,340 B2
APPLICATION NO. : 10/747655
DATED : December 26, 2006
INVENTOR(S) : Byong Kee Kim, Seong Hyeon Hong and Yong Won Woo It is certified that error appears in the above-identified patent and that said Letters Patent is hereby corrected as shown below:

Cover page, Item (75) Inventors:

Change the Inventor as follows from "Byong Kee Kim" to --Byoung Kee Kim--.

Signed and Sealed this

Fifteenth Day of May, 2007

JON W. DUDAS
*Director of the United States Patent and Trademark Office*